US007708423B2

(12) United States Patent
Hong

(10) Patent No.: US 7,708,423 B2
(45) Date of Patent: May 4, 2010

(54) LIGHTED IMAGE RENDERING LAMP

(76) Inventor: Seung-Beom Hong, 3608 W. Pine Orchard Dr., Pearland, TX (US) 77581

( * ) Notice: Subject to any disclaimer, the term of this patent is extended or adjusted under 35 U.S.C. 154(b) by 143 days.

(21) Appl. No.: 12/127,820

(22) Filed: May 28, 2008

(65) Prior Publication Data

US 2009/0296048 A1 Dec. 3, 2009

(51) Int. Cl.
*F21S 6/00* (2006.01)
*G09F 7/00* (2006.01)

(52) U.S. Cl. ..... 362/121; 362/806; 362/812; 40/584; 40/579

(58) Field of Classification Search ..... 362/121, 362/806, 357; 40/564, 579, 584
See application file for complete search history.

(56) References Cited

U.S. PATENT DOCUMENTS

D388,197 S * 12/1997 Cardosi ..... D26/9
5,939,979 A * 8/1999 Lee ..... 340/479
6,558,022 B2 * 5/2003 Kawahara ..... 362/257
6,761,466 B1 * 7/2004 Cheng ..... 362/189
7,287,871 B2 * 10/2007 Wiesberg et al. ..... 362/125
2001/0033489 A1 * 10/2001 Wilson ..... 362/252
2002/0139023 A1 * 10/2002 Gianotti et al. ..... 40/546
2004/0136171 A1 * 7/2004 Patton et al. ..... 362/31
2004/0150993 A1 * 8/2004 McElhaney et al. ..... 362/250
2007/0217185 A1 9/2007 Monahan

* cited by examiner

*Primary Examiner*—Ali Alavi
(74) *Attorney, Agent, or Firm*—Ash Tankha

(57) ABSTRACT

Disclosed herein is an illuminating apparatus for rendering lighted images of different shapes in different directions. The illuminating apparatus comprises a lamp fixture, a perforated dish affixed to the lamp pipe, a lamp shade affixed over the perforated dish, and a dome cover affixed on top of the lamp shade. The lamp fixture comprises a light bulb socket, a lamp pipe, and a lamp base. A light bulb is affixed to the light bulb socket and enclosed within the lamp shade. The dome cover comprises multiple inscriptions. The lamp shade comprises a layered mesh. The layered mesh may comprise wires crossing at right angles. On lighting the light bulb, the light passes through the perforations of the perforated dish, the inscriptions of the dome cover, and between the wires of the layered mesh, thereby rendering the lighted images of the different shapes in different directions.

14 Claims, 11 Drawing Sheets

LIGHTED IMAGE RENDERING LAMP

BACKGROUND

This invention, in general, relates to the field of illuminating apparatuses. More specifically, this invention relates to an illuminating apparatus for providing lighted images of different shapes in different directions.

Illuminating apparatuses are used for lighting indoor and outdoor spaces. Most illuminating apparatuses provide light without shapes or images. It is desirable to have an illuminating device that renders images and shapes, for example the shape of a cross. The cross is a religious symbol of Christianity. The cross is generally seen as a representation of the crucifixion of Jesus. Along with having religious significance, the cross also holds aesthetic value. Hence it is desirable to have an apparatus that renders light in the shape of the cross. Moreover, illuminating apparatuses typically provide illuminated images of fixed unalterable shapes. Other apparatuses that provide light in patterns may only be viewed from a specific side or from particular range of angles.

Hence, there is a need for an illuminating apparatus that renders multiple lighted images of different shapes which are visible in different directions.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The apparatus and method disclosed herein address the above stated need for an illuminating apparatus that provides multiple lighted images of different shapes which are visible in different directions.

The illuminating apparatus, referred to hereafter as the "lighted image rendering lamp", comprises a lamp fixture of variable height, a perforated dish, a lamp shade, and a dome cover. The lamp fixture comprises a light bulb socket, a lamp pipe, and a lamp base. The perforated dish is affixed to the lamp pipe. The lamp shade is affixed over the perforated dish and the dome cover is affixed on top of the lamp shade. A light bulb is affixed to the light bulb socket, and enclosed within the lamp shade. The perforated dish is affixed to the lamp pipe by passing the lamp pipe through an opening in the perforated dish. The perforated dish comprises multiple perforations for producing a first set of lighted images on a bottom surface on lighting the light bulb. The dome cover comprises multiple inscriptions for producing a second set of lighted images on a top surface on lighting the light bulb.

The lamp shade comprises a layered mesh, an outer support casing, and an inner support casing. The layered mesh may comprise wires crossing at right angles, causing majority of the light produced by the light bulb to be rendered as lighted cross shaped images. The lamp shade may further comprise a fiberglass screen for enabling production of the lighted cross shaped images in different directions on lighting the light bulb.

On lighting the light bulb, the light passes through the perforations of the perforated dish, producing the first set of lighted images. The light passes through the inscriptions of the dome cover and produces the second set of lighted images. The light passes between wires of the layered mesh to produce the lighted cross shaped images. The wires of the layered mesh cross at right angles, thereby producing the lighted cross shaped images when light passes between the wires. Shape, intensity, and thickness of the lighted cross shaped images may be changed based on type of the light bulb. Sharpness of the lighted cross shaped images may be varied with distance between the light bulb and the lamp shade.

The perforated dish, the dome cover, and layered mesh therefore render the lighted images of different shapes on lighting the light bulb. The lighted images are produced in different directions.

The lighted image rendering lamp may be used as a night light at home. The lighted image rendering lamp is useful for indoor and outdoor display of lighted cross shaped images, for example, as cemetery markers, in church buildings, or prayer rooms for religious purposes. The lighted image rendering lamp may also be used in the steeple and cupola industry, and in the lamp manufacturing industry. The lighted image rendering lamp may further be used in the screen and plastic manufacturing industry.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
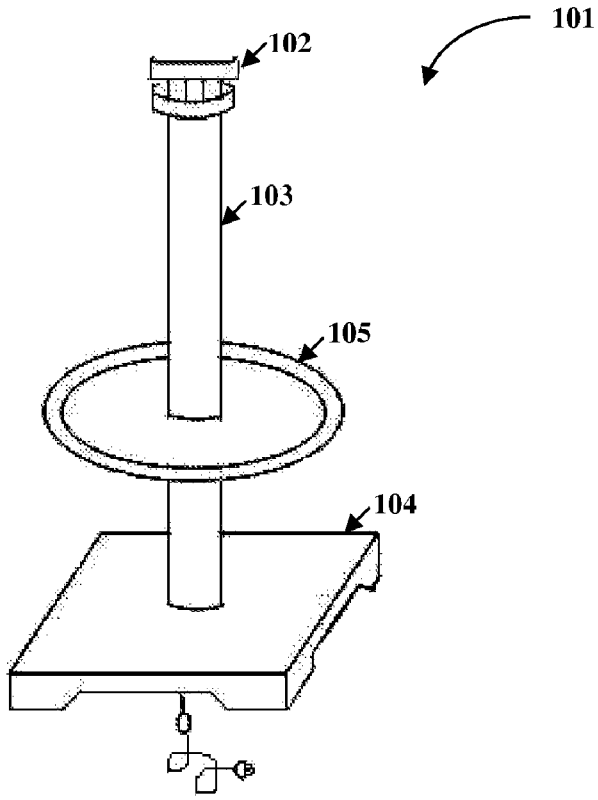
FIG. 1 illustrates the lamp fixture.
Figure 4:
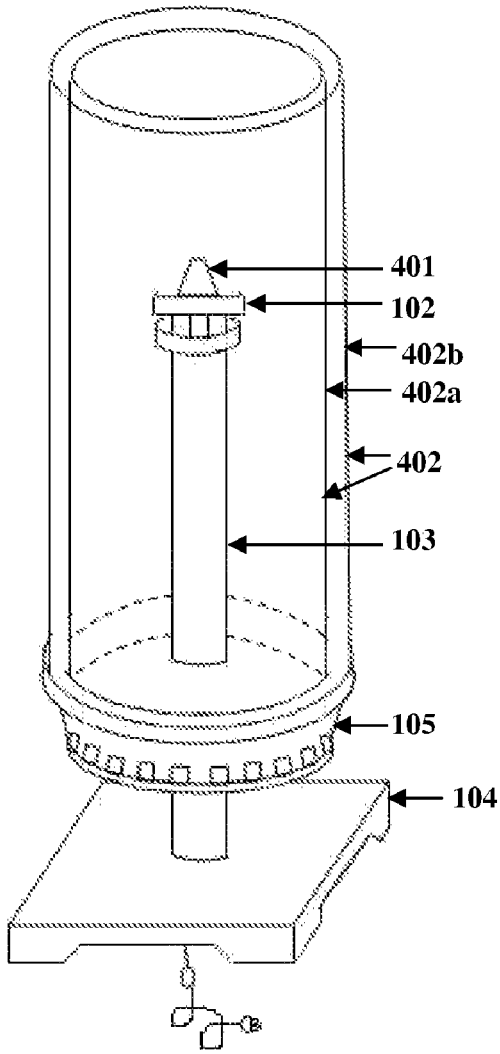
FIG. 4 exemplarily illustrates an indoor lighted image rendering lamp.

The illuminating apparatus disclosed herein renders lighted images of different shapes in different directions. The illuminating apparatus herein referred to as a "lighted image rendering lamp" comprises a lamp fixture 101, a perforated dish 105, a lamp shade 402, and a dome cover 301. FIG. 1 illustrates the lamp fixture 101. The lamp fixture 101 is of variable height. The lamp fixture 101 comprises a lamp pipe 103 with a light bulb socket 102 and a lamp base 104. The perforated dish 105 is affixed to the lamp pipe 103 by passing the lamp pipe 103 through an opening 201 in the perforated dish 105. The lamp shade 402 is affixed over the perforated dish 105, as illustrated in FIG. 4. The dome cover 301 is affixed on top of the lamp shade 402. A light bulb 401 is affixed to the light bulb socket 102, such that the light bulb 401 is enclosed within the lamp shade 402.

Figure 2A:
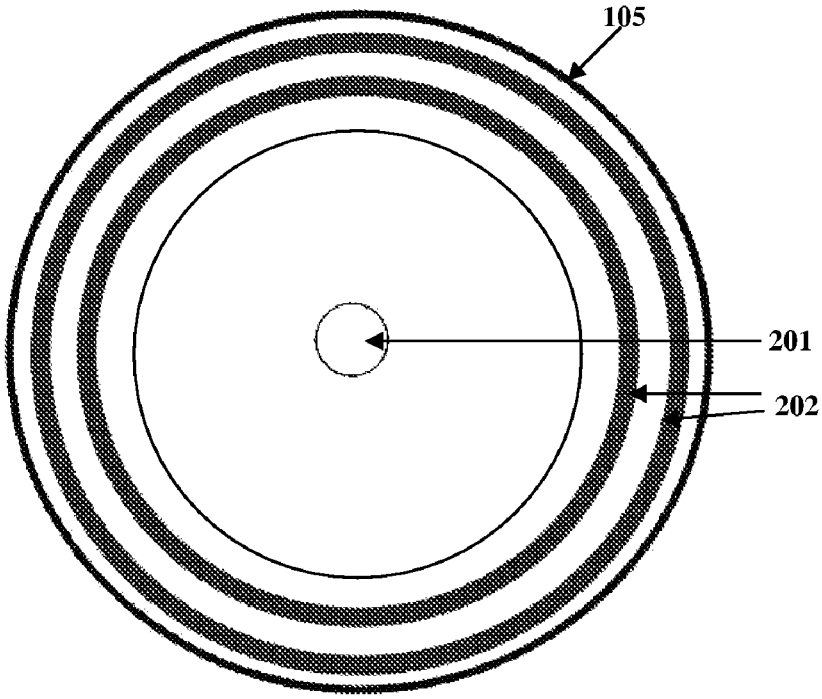
FIG. 2A illustrates a top view of the perforated dish.
Figure 2B:
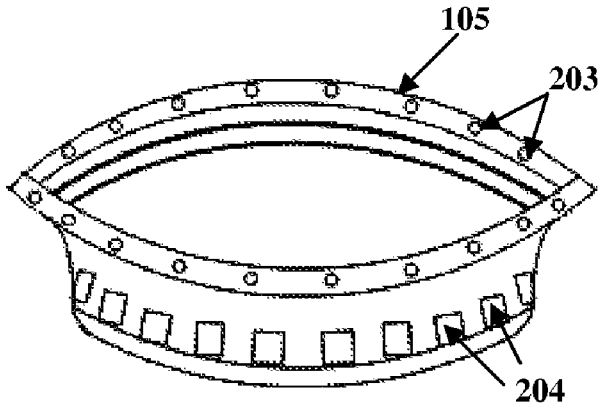
FIG. 2B illustrates a side view of the perforated dish.

FIG. 2A illustrates a top view of the perforated dish 105. The perforated dish 105 comprises an opening 201 for affixing the perforated dish 105 to the lamp pipe 103. The perforated dish 105 further comprises multiple dish grooves 202 for supporting the lamp shade 402. A side view of the perforated dish 105 is illustrated in FIG. 2B. The perforated dish 105 comprises multiple perforations 204 for enabling the production of the first set of lighted images on a bottom surface on lighting the light bulb 401. The first set of lighted images may, for example, be concentric circles with radial rays, as exemplarily illustrated in FIG. 7. On lighting the light bulb 401, light passes through the perforations 204, thereby producing the first set of lighted images. The perforated dish 105 further comprises multiple screw holes 203 for fastening the lamp shade 402 to the perforated dish 105. The design of the perforated dish 105 may be altered to change the shape of the first set of lighted images. The perforated dish 105 may be made of clear plastic. The perforated dish 105 produces lighted images in the shape of annular rings with radial rays as exemplarily illustrated in FIG. 7. The perforated dish 105 may be excluded when the lighted image rendering lamp is used outdoors, as exemplarily illustrated in FIG. 5A.

Figure 3A:
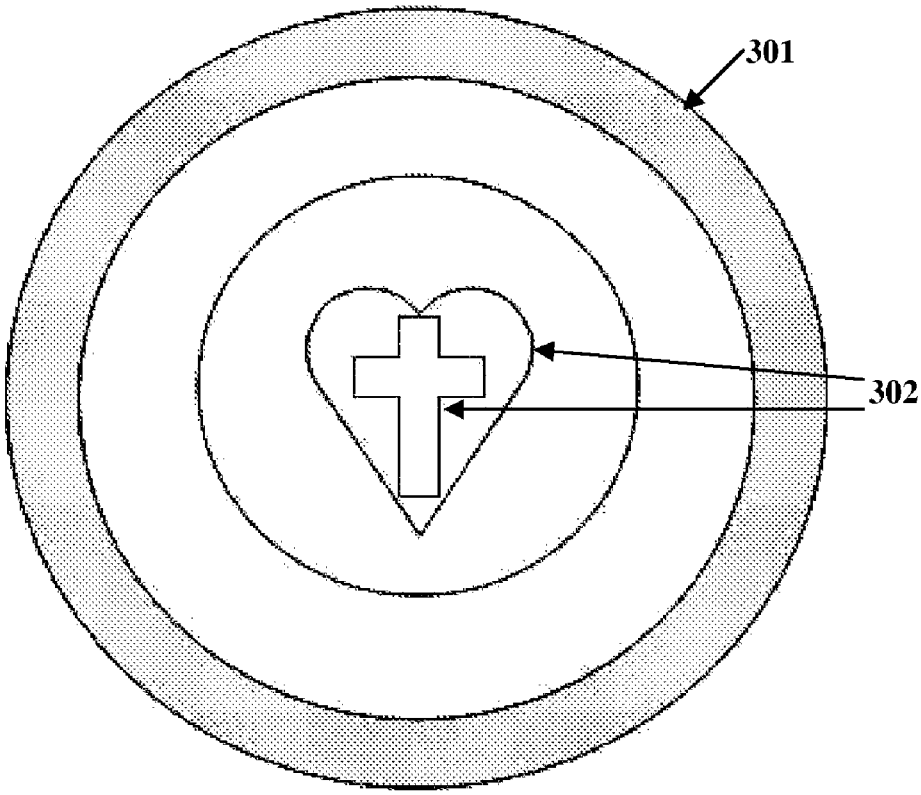
FIG. 3A illustrates a top view the dome cover.
Figure 3B:
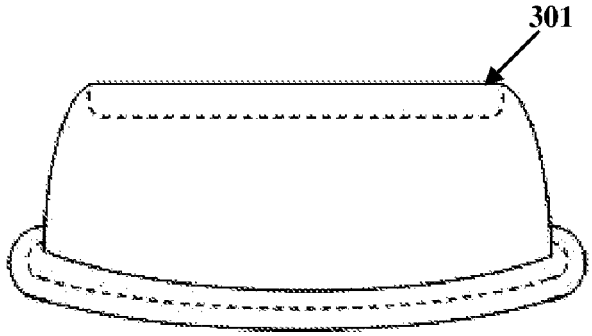
FIG. 3B illustrates a side view of the dome cover.

FIG. 3A illustrates a top view of the dome cover 301. The dome cover 301 comprises multiple inscriptions 302 for enabling production of the second set of lighted images on a top surface on lighting the light bulb 401. For example, the inscriptions 302 may be in the shape of a heart and a cross, as illustrated in FIG. 3A. On lighting the light bulb 401, light passes through the dome cover 301, hence producing the second set of lighted images. The second set of lighted images may, for example, be a cross shaped image inscribed inside a heart shaped image, surrounded by concentric circles of varying thickness, as exemplarily illustrated in FIG. 8. A side view of the dome cover 301 is illustrated in FIG. 3B. The dome cover 301 also prevents infiltration by foreign objects, for example insects or dust, into the lighted image rendering lamp. The dome cover 301 may be made of clear plastic. The dome cover 301 made of clear plastic produces lighted images in the form of concentric circles, as exemplarily illustrated in FIG. 8. Starting from the outer edge of the lamp shade 402, every successive ring, space between the successive rings, and space between radial rays become progressively larger outwards. When the lighted image rendering lamp is used outdoors, the dome cover 301 may be plain black, as exemplarily illustrated in FIG. 5C. The plain black dome cover 502 blocks direct sunlight that may reduce the intensity of the lighted cross shaped images when the lighted image rendering lamp is used outdoors.

The lamp shade 402 comprises a layered mesh 402*c* affixed over the perforated dish 105. The layered mesh 402*c* may comprise wires crossing at right angles, such that the light passing between the wires produces the lighted cross shaped images. The layered mesh 402*c* enables production of lighted cross shaped images in different directions on lighting the light bulb 401. The lamp shade 402 further comprises an inner support casing 402*a* and an outer support casing 402*b* for providing support to the layered mesh 402*c*. The layered mesh 402*c* may be sandwiched between the inner support casing 402*a* and the outer support casing 402*b*. The lighted cross shaped images produced by the light passing through the layered mesh 402*c* may be viewed from different directions. Dimensions of the lighted cross shaped image may be varied by varying the height of the lamp pipe 103.

The lamp shade 402 may also be made of a fiberglass screen. The lamp shade 402 made of a fiberglass screen will produce lighted cross shaped images of lesser intensity. For example, the lamp shade 402 may comprise two glass cylinders or two acrylic glass cylinders having different diameters. The lamp shade 402 comprising two glass or acrylic glass cylinders may have up to four layers. The lamp shade 402 may be made in different shapes. For example, the lamp shade 402 may be made in a rectangular, square, cubic, hexagonal, or spherical shape. For a lighted image rendering lamp having the lamp shade 402 in any shape other than cylindrical, the shape of the lighted cross shaped images may be distorted when viewed from any direction other than straight.

As an example, lighted cross shaped images may be produced on a wall by using the lamp shade 402 as a wall sconce. The lamp shade 402 used as a wall sconce may be a cylindrical or a curved panel type of lamp shade 402. The curved panel type of lamp shade 402 may also be mounted in a wall recess. The curved panel type of lamp shade 402 may comprise a layered mesh 402*c*. The perforated dish 105 and the dome cover 301 may not be used with the curved panel type of lamp shade 402.

The lamp shade 402 may also be made using a type of black mesh having different mesh numbers. If a mesh having rectangular openings, for example an 18×13 mesh, is used for two or more layers of the lamp shade 402, the longer sides of the rectangular mesh openings may be positioned along the axis of lamp fixture 101 for the first layer and across the axis of lamp fixture 101 for the second layer alternately. If the longer sides of the rectangular mesh openings are positioned along the axis of the lamp fixture 101, greater intensity of light will be produced in a vertical direction. If the longer sides of the rectangular mesh openings are lined across the axis of cylinder, greater intensity of light will be produced in a horizontal direction.

FIG. 4 exemplarily illustrates an indoor lighted image rendering lamp. In FIG. 4, the lamp shade 402 comprises two layers supported by one of the inner support casing 402*a* and the outer support casing 402*b*. The lamp shade 402 comprises an inner cylindrical layer made using black or charcoal coated aluminum, and an outer cylindrical layer made using black polyester coated stainless steel. The inner cylindrical layer may have, for example, a diameter of 6.1 inches and a height of 18 inches and may be made of an 18×16 mesh. The inner cylindrical layer may comprise wires of 0.011 inch diameter. The outer cylindrical layer may have, for example, a diameter of 7.3 inches and a height of 18 inches and may be made of a 20×20 mesh. The outer cylindrical layer mesh may comprise wires of 0.007 inch diameter. The inner cylindrical layer and the outer cylindrical layer are inserted into the dish grooves 202 of the perforated dish 105. The outer cylindrical layer is fastened onto the perforated dish 105 through the screw holes 203. The perforations 204 allow free air flow. The distance between the inner cylindrical layer and outer cylindrical layer may be 0.69 inch.

Figure 5A:
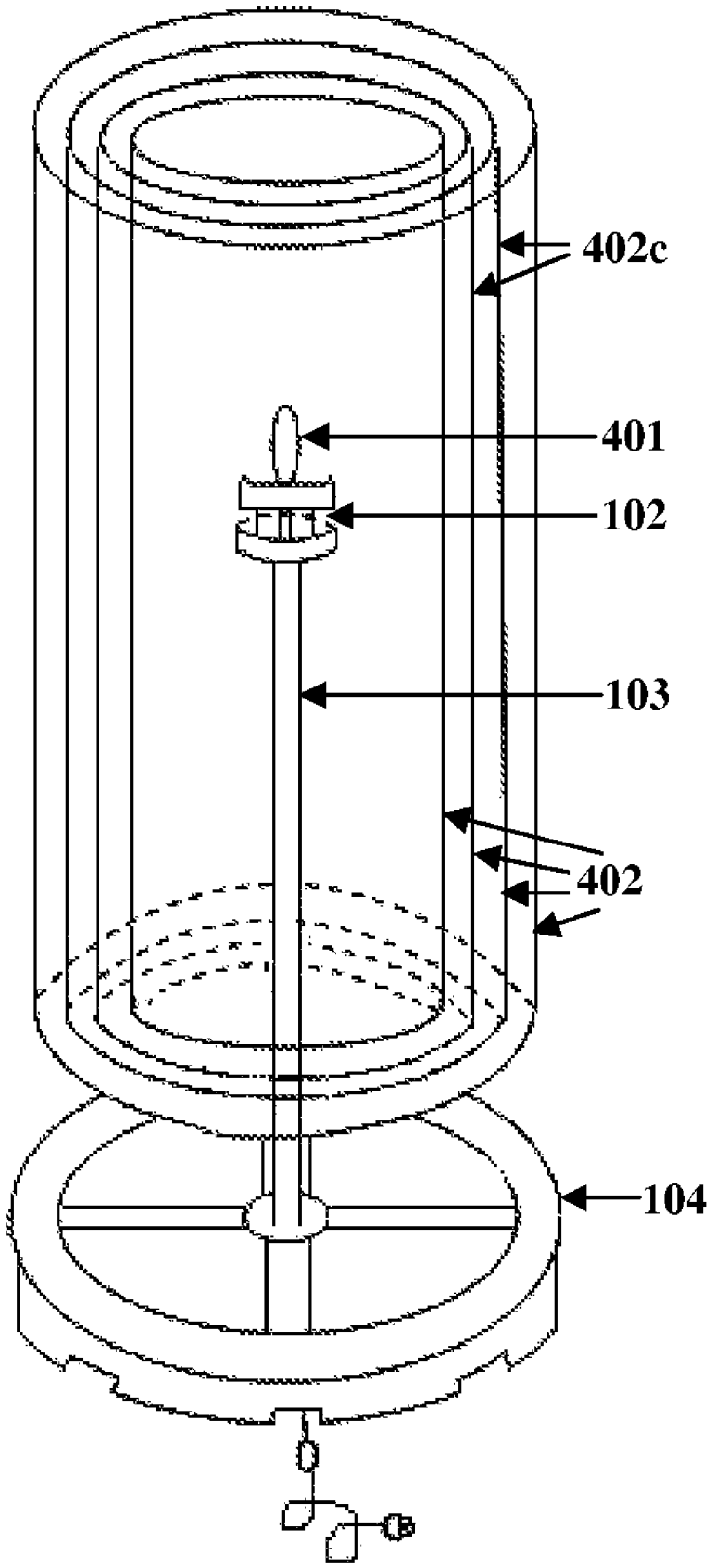
FIG. 5A exemplarily illustrates an outdoor lighted image rendering lamp.
Figure 5B:
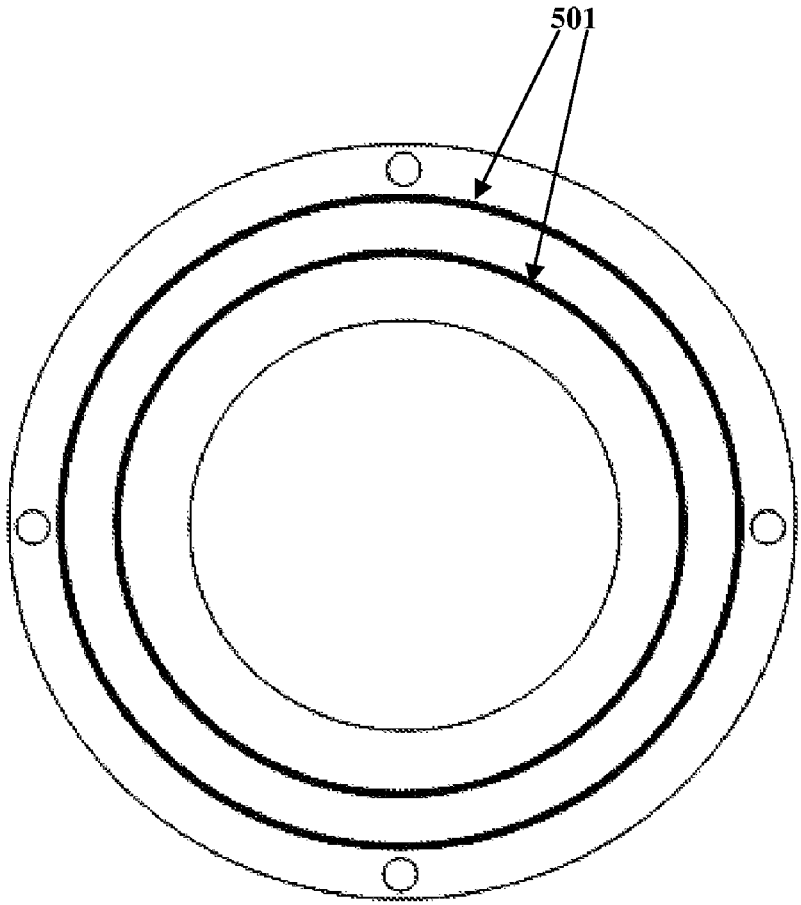
FIG. 5B exemplarily illustrates a ring holder of the outdoor lighted image rendering lamp.

FIG. 5A exemplarily illustrates an outdoor lighted image rendering lamp. The perforated dish 105 may be excluded when the lighted image rendering lamp is used outdoors. The outdoor lighted image rendering lamp may comprise a ring holder, as exemplarily illustrated in FIG. 5B. In FIG. 5A, the lamp base 104 is shown to be round. The lamp shade 402 in FIG. 5A, comprises four cylindrical layers of mesh. The three inner cylindrical layers may be made of black aluminum, and the outer layer may be made of black polyester coated stainless steel. The three inner cylindrical layers may have, for example, a height of 36 inches and have diameters of 9.25 inches, 10.17 inches, and 11.09 inches respectively. The three inner cylindrical layers may be made of an 18×16 mesh. The mesh for the inner cylindrical layers may comprise wires of 0.011 inch diameter. The outer cylindrical layer may have, for example, a diameter of 12.01 inches and a height of 36 inches and may be made of a 20×20 mesh. The mesh for the outer cylindrical layer may comprise wires of 0.007 inch diameter. Two cylindrical layers of the layered mesh 402*c* are inserted into ring holder grooves 501. The innermost cylindrical layer is attached to the inside of the ring holder. The outermost cylindrical layer is attached to the outside of the ring holder. The distance between two adjacent cylindrical layers may be 0.92 inches.

Figure 5C:
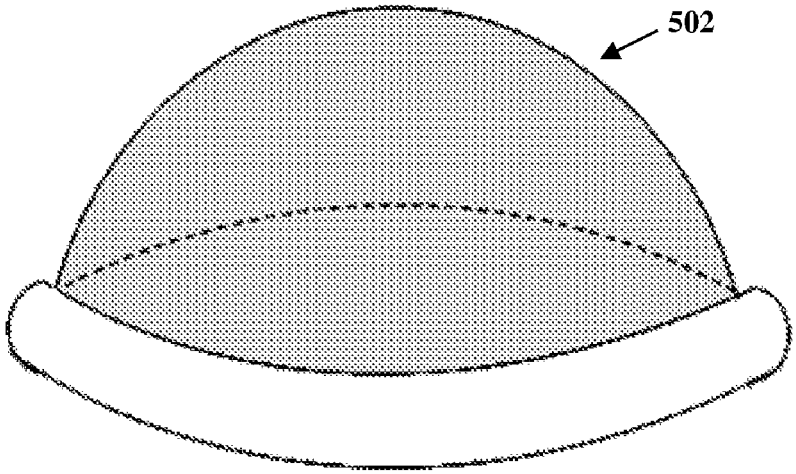
FIG. 5C exemplarily illustrates a plain black dome cover for use with the outdoor lighted image rendering lamp.

For the outdoor lighted image rendering lamp, a plain black dome cover 502 may be used. A side view of the plain black dome cover 502 for the outdoor lighted image rendering lamp is illustrated in FIG. 5C. The plain black dome cover 502 blocks direct sunlight that may reduce the intensity of the lighted cross shaped images. The outdoor lighted image rendering lamp may further comprise a solar skin panel, for example a solar skin panel manufactured by HelioVolt Corporation, mounted onto the plain black dome cover 502. The solar skin panel may be electrically connected to a rechargeable battery to enable production of the lighted images at night.

The type of the light bulb 401 may be varied to produce lighted images of varying thickness and intensity. If a clear halogen bi-pin bulb is used, lighted images produced from the light bulb 401 are clearly visible even under bright fluorescent indoor lighting. A clear halogen bi-pin bulb of specifications, for example, Gy 6.35 or Gy 8.0 base; 35 watt; 120 volt may be used as the light bulb 401 for indoor use of the lighted image rendering lamp. A clear halogen bulb used along with the plain black dome cover 502 produces lighted images clearly visible even under direct sunlight. A clear halogen bulb of specifications, for example, E-11 base JCP 100 volt/650 watts may be used as the light bulb 401 for outdoor use of the lighted image rendering lamp. Both the shape and the type of glass of the light bulb 401 also influence the configuration of the lighted images. The color of the lighted images may also be varied by using a colored light bulb.

Figure 6A:
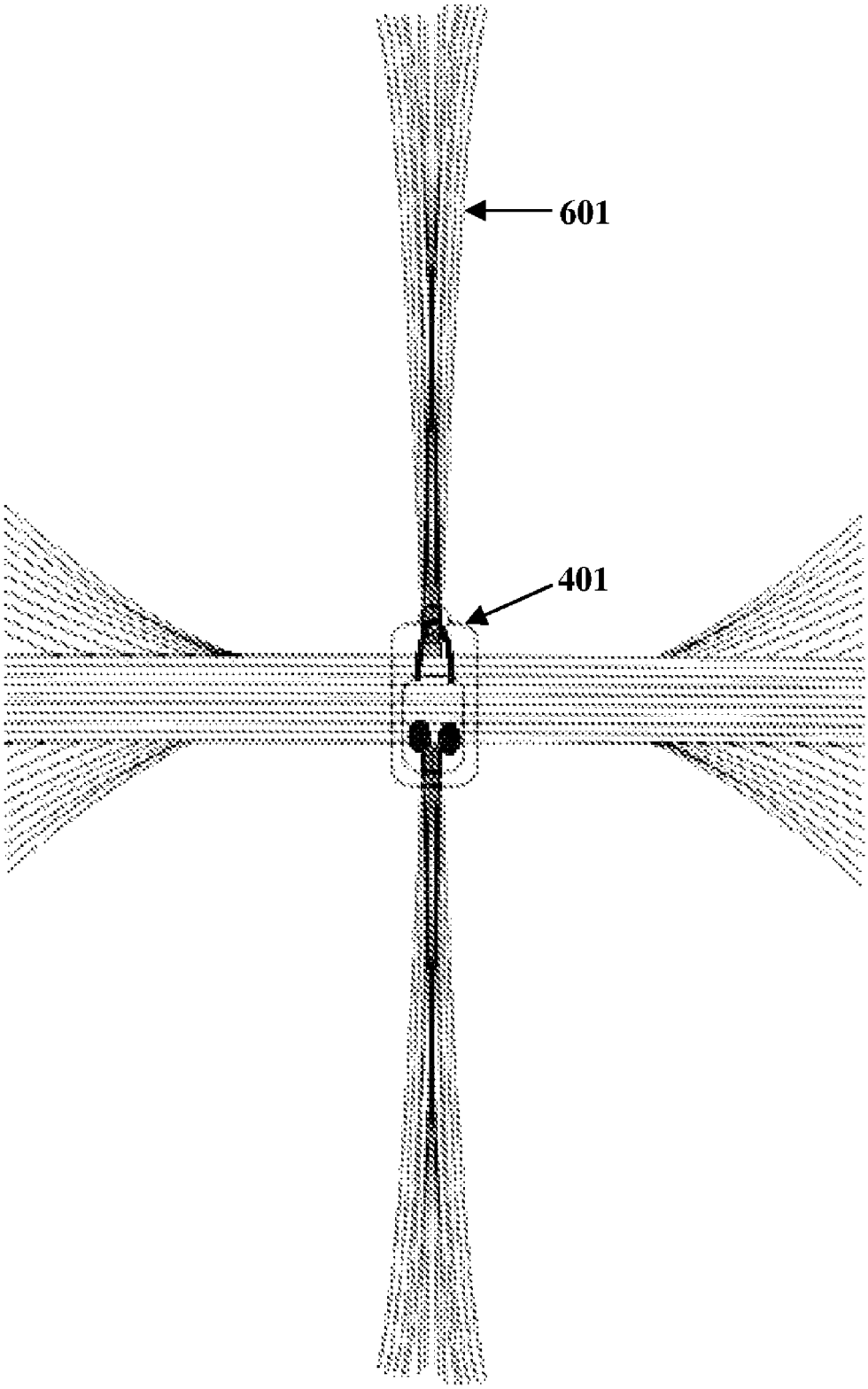
FIGS. 6A-6B exemplarily illustrate different types of the lighted cross shaped images.
Figure 6B:
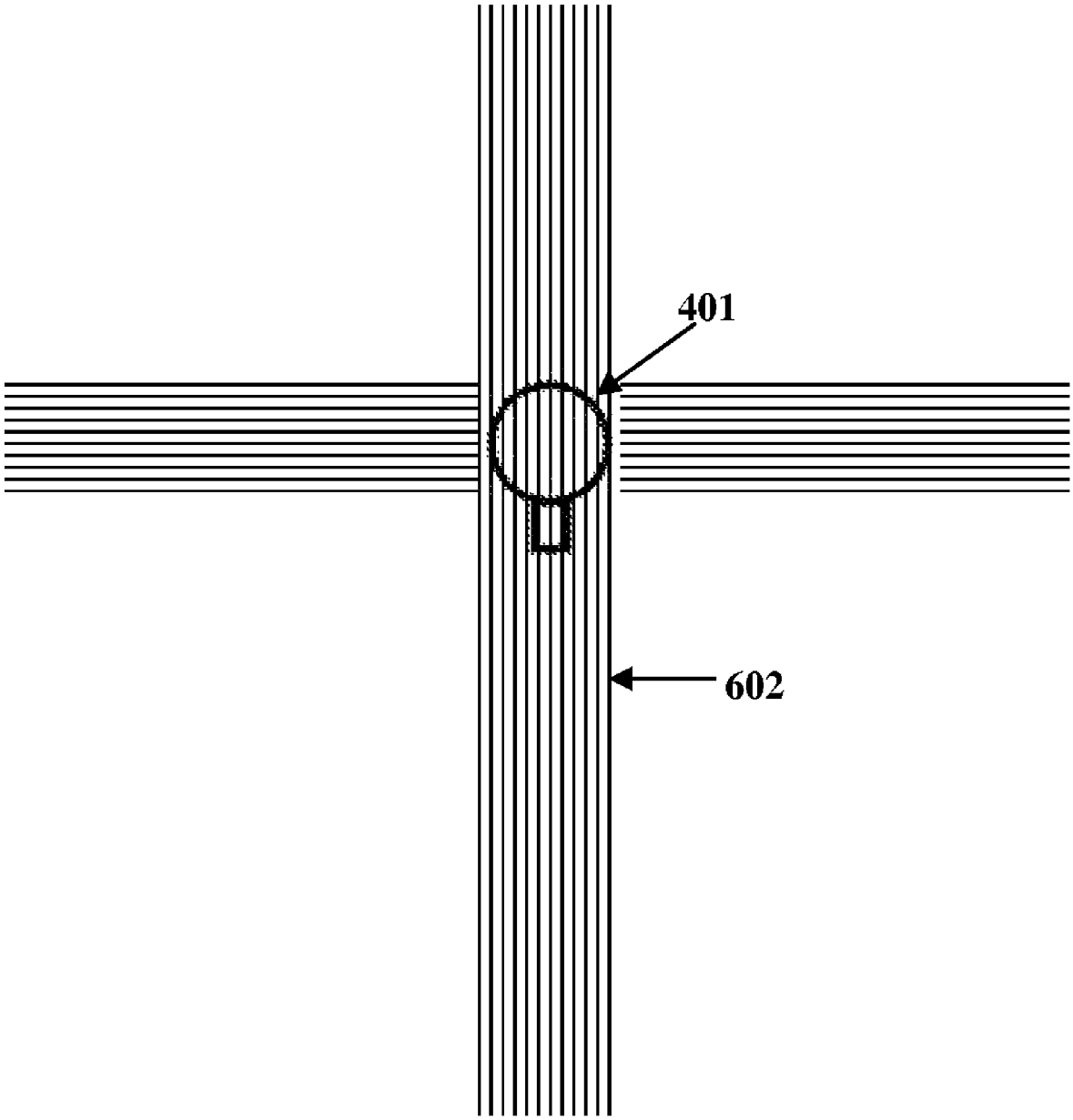

FIG. 6A exemplarily illustrates a wedge type of lighted cross shaped image. The wedge type of lighted cross shaped image is produced by using a clear halogen type of light bulb 401. The wedge type of lighted cross shaped image has slant rays 601. A square type of lighted cross image is exemplarily illustrated in FIG. 6B. The square type of lighted cross shaped image is produced by using a white finished globe type of light bulb 401. The square type of lighted cross shaped image has straight rays 602.

Figure 7:
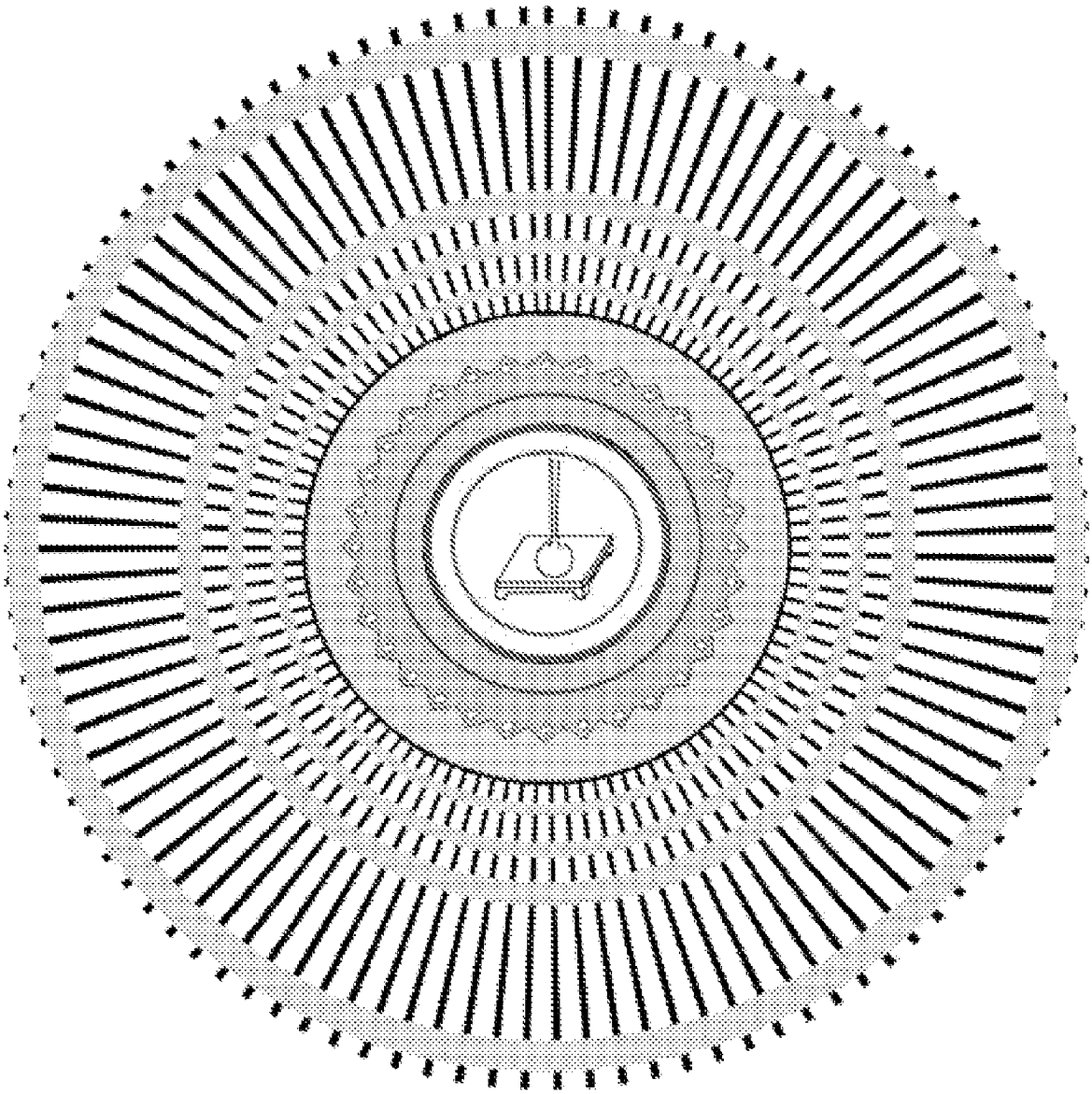
FIG. 7 exemplarily illustrates the first set of lighted images produced on a bottom surface on light passing through the perforated dish.
Figure 8:
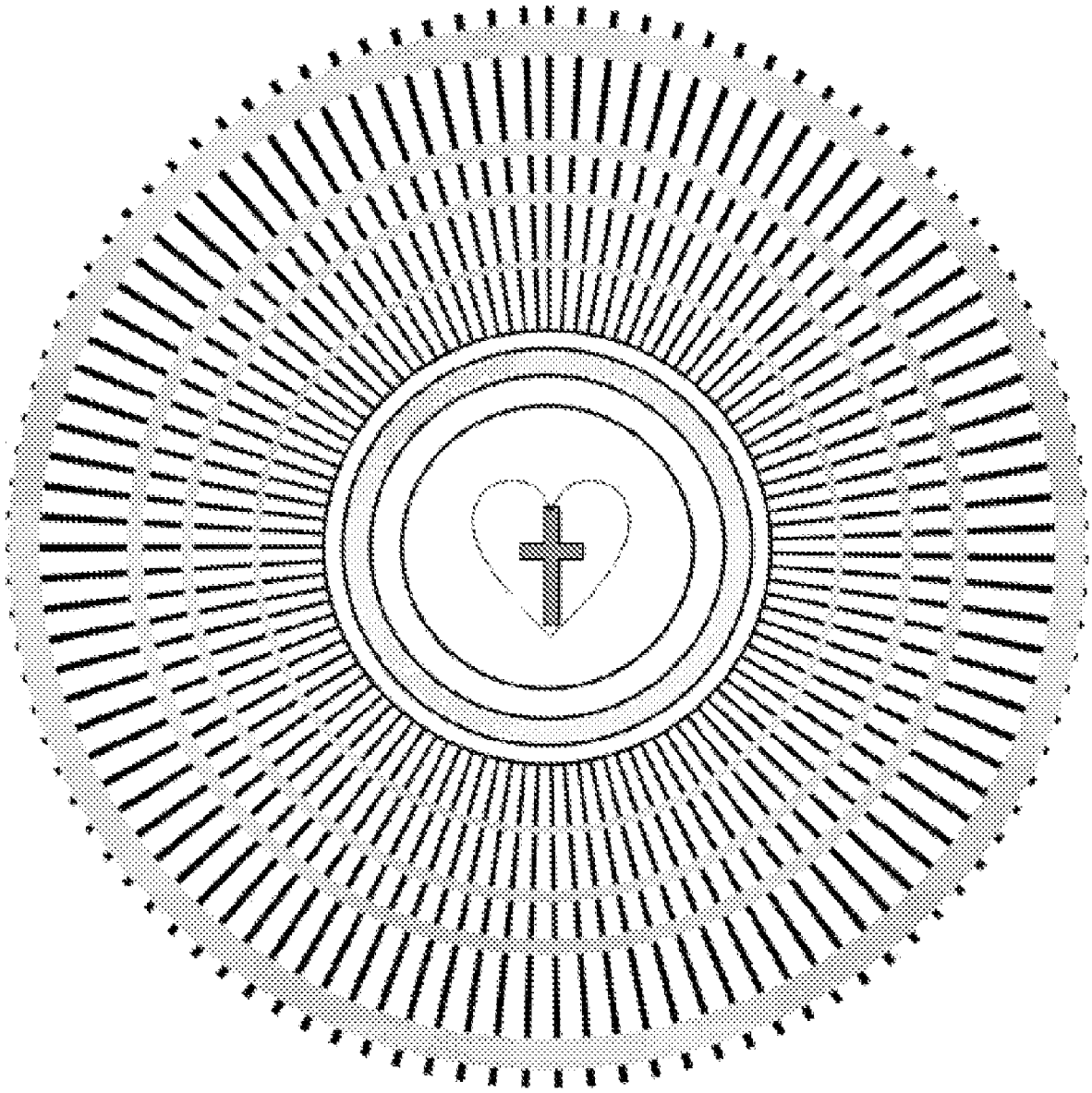
FIG. 8 exemplarily illustrates the second set of lighted images produced on a top surface on light passing through the dome cover.

FIG. 7 exemplarily illustrates the first set of lighted images produced on a bottom surface on light passing through the perforated dish 105. The second set of lighted images may be produced on a floor. The lighted images are produced when light from the light bulb 401 passes through the perforations 204 of the perforated dish 105. The second set of lighted images produced on a top surface on light passing through the dome cover 301 is illustrated in FIG. 8. The second set of lighted images may be produced on a ceiling. In FIG. 7, the dome cover 301 has inscriptions 302 of a cross and a heart.

Figure 9:
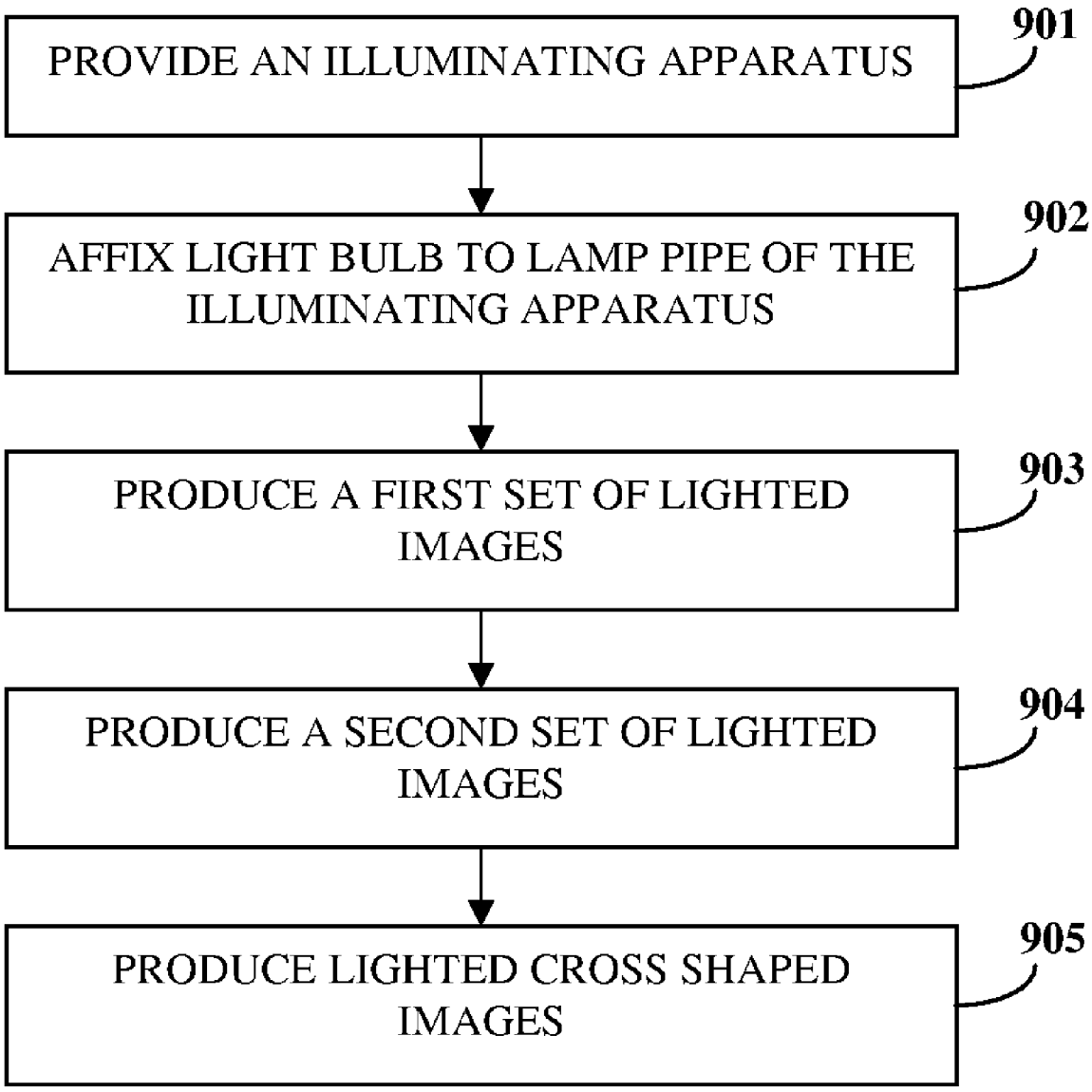
FIG. 9 illustrates a method of rendering lighted images of different shapes in different directions using a lighted image rendering lamp.

FIG. 9 illustrates a method of rendering lighted images of different shapes in different directions using a lighted image rendering lamp. The lighted image rendering lamp is provided 901. The lighted image rendering lamp comprises a lamp fixture 101, a perforated dish 105, a dome cover 301, and a lamp shade 402, comprising a layered mesh 402*c*. The lamp fixture 101 comprises a lamp pipe 103 with a light bulb socket 102 and a lamp base 104. A light bulb 401 is affixed 902 to the lamp pipe 103, such that the light bulb 401 is enclosed within the lamp shade 402. A first set of lighted images is produced 903 on a bottom surface on lighting the light bulb 401. The first set of lighted images is produced when light from the light bulb 401 passes through the perforated dish 105. The light passes through multiple perforations 204 in the perforated dish 105 to produce the first set of lighted images. A second set of lighted images is produced 904 on a bottom surface on the lighting of the light bulb 401. The second set of lighted images is produced when the light from the light bulb 401 passes through the dome cover 301. The light passes through multiple inscriptions 302 in the dome cover 301 to produce the second set of lighted images.

Multiple lighted cross shaped images are produced 905 in different directions on the lighting of the light bulb 401. The lighted cross shaped images are produced when the light from the light bulb 401 passes through the layered mesh 402*c* of the lamp shade 402. The light passes between wires of the layered mesh 402*c* of the lamp shade 402 to produce the lighted cross shaped images. The wires of the layered mesh 402*c* cross at right angles, thereby rendering lighted cross shaped images when the light passes between the wires. Shape, intensity, and thickness of the lighted cross shaped images may be varied by changing type of the light bulb 401.

Figure 10:
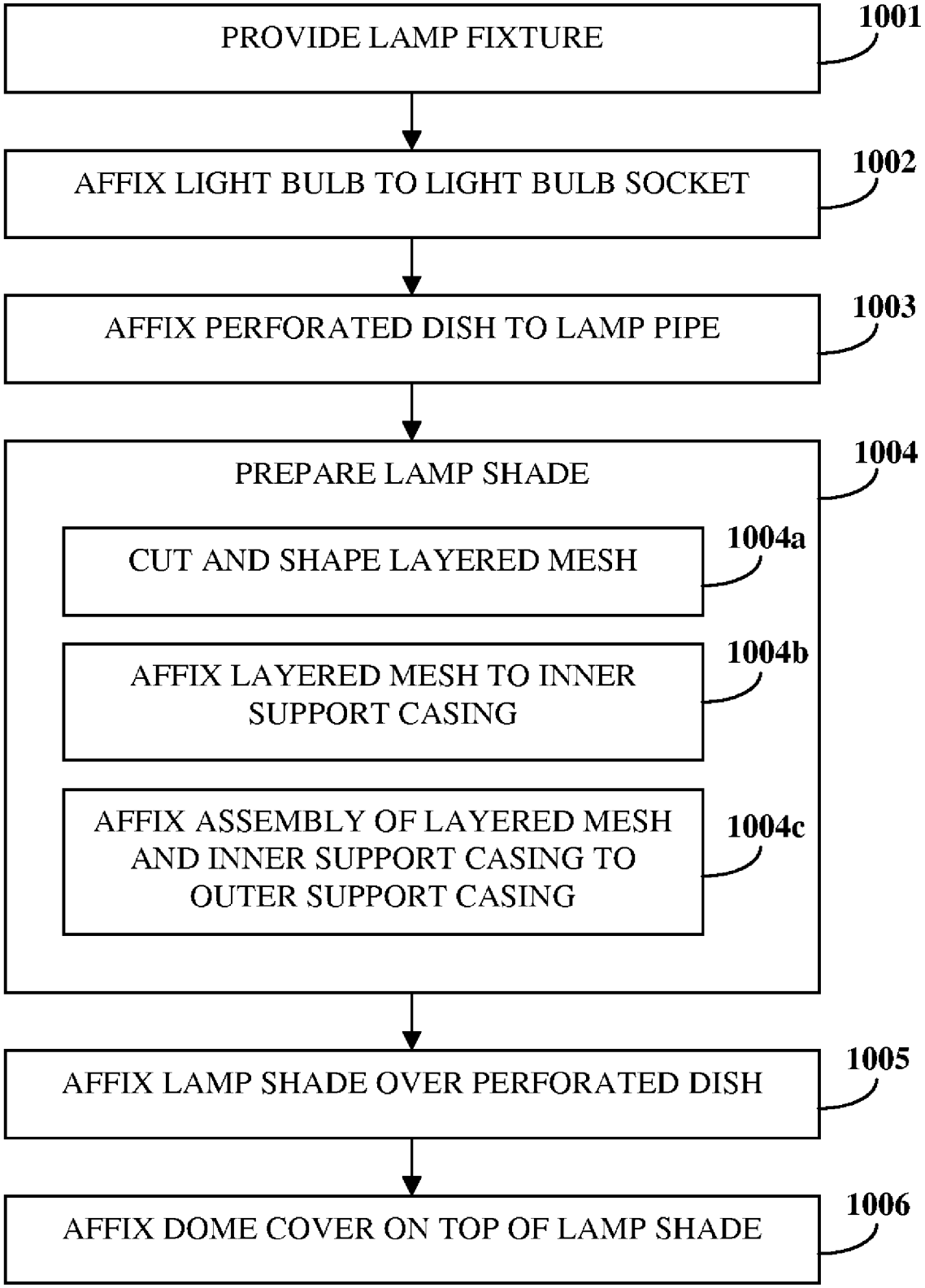
FIG. 10 exemplarily illustrates a method of manufacturing a lighted image rendering lamp for rendering lighted images of different shapes in different directions.

FIG. 10 illustrates a method of manufacturing a lighted image rendering lamp for rendering lighted images of different shapes in different directions. A lamp fixture 101 of variable height is provided 1001. The lamp fixture 101 comprises a light bulb socket 102, a lamp pipe 103, and a lamp base 104. A light bulb 401 is affixed 1002 to the light bulb socket 102. A perforated dish 105 is affixed 1003 to the lamp pipe 103 by passing the lamp pipe 103 through an opening 201 in the perforated dish 105. A lamp shade 402 is prepared 1004, comprising the steps of: cutting and shaping 1004*a* a layered mesh 402*c*, affixing 1004*b* the cut and shaped layered mesh 402*c* to an inner support casing 402*a*, and affixing 1004*c* assembly of the layered mesh 402*c* and the inner support casing 402*a* to an outer support casing 402*b*. The assembly of the layered mesh 402*c* and the inner support casing 402*a* may be affixed to the outer support casing 402*b* such that the layered mesh 402*c* is sandwiched between the inner support casing 402*a* and the outer support casing 402*b*. The lamp shade 402 is affixed 1005 over the perforated dish 105, such that the lamp shade 402 encloses the light bulb 401. A dome cover 301 is affixed 1006 on top of the lamp shade 402. The dome cover 301 comprises multiple inscriptions 302 for enabling production of a first set of lighted images on a top surface.

The lighted image rendering lamp renders lighted images of different shapes in different directions. The shapes, intensity, and sharpness of the images may be varied. The images are visible from different directions.

The lighted image rendering lamp may be used as an indoor or outdoor pendant lamp, a ceiling light, a post light, a wall light, or a lantern. Furthermore, the lighted image rendering lamp and a fluorescent lamp may be combined together on a single lamp fixture 101 with a lamp pipe 103 branching downwards. The lighted image rendering lamp may be mounted on top and light bulb sockets provided on the branched lamp pipe ends, along with a two way light switch or a sensor light switch.

The lighted image rendering lamp may also be produced in a miniature size. The miniature lighted image rendering lamp may comprise an inner cylinder, an outer cylinder, and a battery-powered light emitting diode (LED) light bulb. The inner cylinder may have, for example, a diameter of 1 inch and a height of 3.5 inches and may be made of a black aluminum 18×13 mesh. The outer cylinder may have, for example, a diameter of 1.25 inches and a height of 3.5 inches, made of a black stainless steel 20×20 mesh. The lamp shade 402 for the miniature lighted image rendering lamp may also have only a single cylindrical layer. The position of the LED light bulb with respect to the light bulb socket 102 is important. If the LED light bulb is too close to the light bulb socket 102, then the lighted cross shaped images may not be produced.

The foregoing examples have been provided merely for the purpose of explanation and are in no way to be construed as limiting of the present method and system disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An illuminating apparatus for rendering lighted images of different shapes in different directions, comprising:

a lamp fixture of variable height, wherein said lamp fixture comprises a lamp pipe with a light bulb socket and a lamp base;

a perforated dish affixed to said lamp pipe by passing the lamp pipe through an opening in said perforated dish, wherein the perforated dish enables production of a first set of lighted images on a surface on lighting a light bulb affixed to said light bulb socket on the lamp pipe;

a lamp shade comprising a layered mesh, affixed over the perforated dish, wherein said layered mesh enables production of lighted cross shaped images in said different directions on lighting said light bulb; and a dome cover affixed on top of said lamp shade, wherein said dome cover enables production of a second set of lighted images on a surface on lighting the light bulb;

whereby the perforated dish, the dome cover, and the lamp shade render said lighted images of said different shapes in different directions on lighting the light bulb.

2. The illuminating apparatus of claim 1, wherein the lamp shade further comprises an outer support casing and an inner support casing for providing support to the layered mesh by sandwiching the layered mesh between said outer support casing and said inner support casing.

3. The illuminating apparatus of claim 1, wherein said layered mesh comprises wires crossing at right angles, wherein the light passing between said wires produces said lighted cross shaped images.

4. The illuminating apparatus of claim 1, wherein the lamp shade comprises a fiberglass screen for enabling said production of said lighted cross shaped images in different directions on lighting the light bulb.

5. The illuminating apparatus of claim 1, wherein the perforated dish comprises multiple perforations for enabling said production of said first set of lighted images on said surface on lighting the light bulb.

6. The illuminating apparatus of claim 1, wherein the light bulb is enclosed within the lamp shade, wherein said enclosure enables said lighted cross shaped images to be viewed in different directions.

7. The illuminating apparatus of claim 1, wherein the dome cover comprises multiple inscriptions for enabling said production of said second set of lighted images on said surface on lighting the light bulb.

8. The illuminating apparatus of claim 1, wherein shape, intensity, and thickness of said lighted cross shape images is based on type of the light bulb.

9. A method of rendering lighted images of different shapes in different directions using an illuminating apparatus, comprising the steps of:

providing said illuminating apparatus comprising a lamp fixture, a perforated dish, a dome cover, and a lamp shade comprising a layered mesh, wherein said lamp fixture comprises a lamp pipe with a light bulb socket and a lamp base;

affixing a light bulb to said lamp pipe, wherein said light bulb is enclosed within said lamp shade;

producing a first set of lighted images on a surface on lighting the light bulb, wherein said first set of lighted images is produced when light from the light bulb passes through said perforated dish;

producing a second set of lighted images on a surface on said lighting of the light bulb, wherein said second set of lighted images is produced when said light from the light bulb passes through said dome cover; and producing lighted cross shaped images in said different directions on the lighting of the light bulb, wherein said lighted cross shaped images are produced when the light from the light bulb passes through said layered mesh of the lamp shade.

10. The method of claim 9, wherein the light passes through multiple perforations in the perforated dish to produce the first set of lighted images on said surface.

11. The method of claim 9, wherein the light passes through multiple inscriptions in the perforated dish to produce the second set of lighted images on said surface.

12. The method of claim 9, wherein the light passes between wires of the layered mesh to produce the lighted cross shaped images, wherein said wires of the layered mesh cross at right angles.

13. The method of claim 9, further comprising the step of varying shape, intensity, and thickness of the lighted cross shaped images by changing type of the light bulb.

14. The method of claim 9, further comprising the step of varying sharpness of the lighted cross shaped images by varying distance between the light bulb and the lamp shade.

* * * * *